US006577843B2

(12) United States Patent
Akita et al.

(10) Patent No.: US 6,577,843 B2
(45) Date of Patent: Jun. 10, 2003

(54) IMAGE FORMING APPARATUS

(75) Inventors: Hiroshi Akita, Tokyo (JP); Takahiro Tsuchiya, Tokyo (JP); Kyoichi Mizuno, Tokyo (JP); Kunihiro Kawachi, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/067,060

(22) Filed: Feb. 4, 2002

(65) Prior Publication Data

US 2002/0150413 A1 Oct. 17, 2002

(30) Foreign Application Priority Data

Feb. 9, 2001 (JP) ..... 2001-033490

(51) Int. Cl.[7] ..... G03G 15/00
(52) U.S. Cl. ..... 399/396; 399/385
(58) Field of Search ..... 399/68, 388, 389, 399/394, 395, 396

(56) References Cited

U.S. PATENT DOCUMENTS 5,745,832 A * 4/1998 Yoshiuchi ..... 399/384
6,453,149 B1 * 9/2002 Dobbertin et al. ..... 399/388

* cited by examiner

*Primary Examiner*—Hoang Ngo
(74) *Attorney, Agent, or Firm*—Frishauf, Holtz, Goodman & Chick, P.C.

(57) ABSTRACT

An image forming apparatus includes, a rotatable image carrier, a writing exposure device to write the image and form a latent image in the rotatable image carrier, a developing device to form a toner image, a registration roller to convey a transfer sheet to an image transfer area where the toner image is transferred from the image carrier onto the transfer sheet, and a fixing roller to heat and fix the toner image, wherein when the length of a transfer sheet is longer than the length of the transfer sheet path between the registration roller and the fixing roller, according to the size of the transfer sheet, the controller changes and controls the relative rotating speed of the registration roller to a rotating speed of the fixing roller, and one of a rotating speed of the rotatable image carrier and a writing speed of the image.

5 Claims, 3 Drawing Sheets

IMAGE FORMING APPARATUS

BACKGROUND OF THE INVENTION

The present invention relates to an image forming apparatus which transfers a toner image formed on an image carrier onto a transfer sheet.

In a conventional image forming apparatus of an electrophotographic process, and in particular, in an image forming apparatus having a transfer means for transferring a toner image electrostatically, an image carrier, a sheet feeding roller located to precede a transfer area (hereinafter referred to as a registration roller) and a heating and rotating body which heats and fixes a toner image on a transfer sheet (hereinafter referred to as a fixing roller), a buckle of transfer sheet in a feeding path affects image quality, especially there is a defect that the buckle generates a jitter of an image (hereinafter referred to as a transfer jitter), which has been a problem. It is presumed that this defect occurs more easily in a transfer means wherein a close contact of a transfer sheet in a transfer area is not so satisfactory like a corona transfer, than in a transfer means wherein a close contact of a transfer sheet is better in a transfer area, like a roller transferring or a belt transferring.

Generally, the buckle of a sheet in a feeding path is caused by a speed difference between a linear speed of a fixing roller and that of a registration roller located to precede a transfer area of the image carrier, in cases where the length of a transfer sheet is longer than the length of the transfer sheet path from the nip position of the registration roller to the nip position of the fixing roller. And the buckle occurs when the linear speed of the fixing roller is relatively slow. However, in order to make a higher close contact between the image carrier and the transfer sheet in the transfer area, an appropriate buckle of the transfer sheet gives good results, further, decreases a crease caused by a pressure contact of a transfer roller.

If this buckling amount becomes greater than a reasonable amount, the buckling is released just after a trailing edge of a sheet passes through the registration roller, and the transfer sheet goes backward against the image carrier at the transfer area, and therefore, for example, a transfer jitter (hereinafter referred to as a trailing edge transfer jitter), which is shaped likely to be compressed, occurs near a trailing edge of the sheet in the feeding direction of the transfer sheet. Especially, this tendency is observed in the image forming apparatus in which the transfer sheet is conveyed vertically near the transfer area.

Further, in order to prevent the crease from occurring on the sheet, there may be given a difference between a diameter of a central section and that of both ends of a roller, and in this case, the diameter of the central section of the roller is made smaller. Accordingly, the linear speed of the central section of the fixing roller is lower than that of the both ends of the fixing roller. When the sheet, whose width is narrower corresponding to the center part of the roller, is used, the difference between the linear speed of the fixing roller and that of the registration roller becomes large to increase the buckling amount, thus, there is a tendency that the trailing edge transfer jitter occurs easily.

Further, when the sheet width is the same for various types of the transfer sheets, the longer the length of the sheet is, the greater the total amount of the buckling becomes, resulting a disadvantage for the trailing edge transfer jitter.

On the other hand, when the rotating speed of the registration roller is changed, there is a fear that a lengthwise magnification of an image will go wrong. Accordingly, it is necessary to reduce the influence on the lengthwise magnification of the image, as well as to control the occurrence of the transfer jitter.

It is an object of the present invention to provide an image forming apparatus in which the transfer jitter of the trailing edge of the image can be prevented from occurring as far as possible, even when a transfer sheet size varies, and in which errors of the image lengthwise magnification are less.

SUMMARY OF THE INVENTION

The object of the invention is attained by the following structures.

Structure (1) An image forming apparatus having a image reading device which reads an image by scanning a document, a writing exposure device which forms the image as a latent image on an image carrier, a developing device which forms a toner image by developing the latent image, a registration roller which conveys a transfer sheet to a transfer area, and is driven by a driving source being different from that for the image carrier, and a rotating heat body which heats and fixes the transfer sheet on which the toner image is transferred, wherein, there is provided a control means which changes and controls rotating speed of the registration roller according to the sizes of the transfer sheets, and changes and controls reading and scanning speed for the document.

Structure (2) An image forming apparatus having a writing exposure device which forms an image as a latent image on an image carrier, a developing device which develops the latent image into a toner image, a registration roller which feeds a transfer sheet to a transfer area, and is driven by a driving source being different from that for the image carrier, and a heating and rotating body which heats and fixes the transfer sheet on which the toner image is transferred, wherein, there is provided a control means which changes and controls rotating speed of the registration roller according to the sizes of the transfer sheets, and changes and controls writing speed onto the image carrier.

Structure (3) An image forming apparatus having a writing exposure device which forms an image as a latent image on an image carrier, a developing device which develops the latent image into a toner image, a registration roller which feeds the transfer sheet to a transfer area, and is driven by a driving source being different from that of the image carrier, and a rotating heat body which heats and fixes the transfer sheet on which the toner image is transferred, wherein, there is provided a control means which changes and controls rotating speed of the registration roller according to the sizes of the transfer sheets, and changes and controls rotating speed of the image carrier and rotating speed of the heating and rotating body.

DETAILED DESCRIPTION OF THE PREFERRED EMBODIMENT

An example of the embodiment of the present invention is explained based on the drawings as follows.

Figure 1:
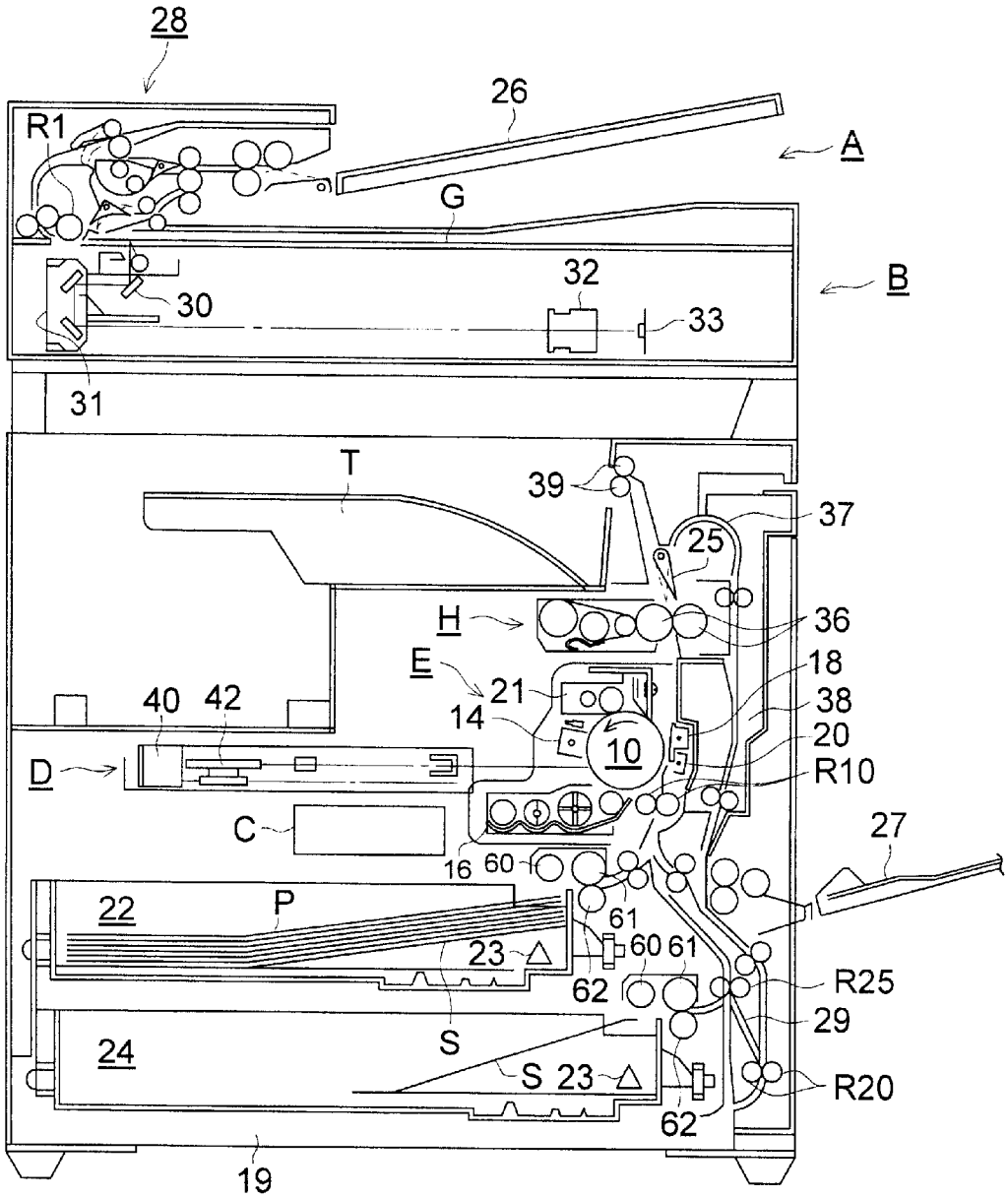
FIG. 1 is an illustrative drawing showing the construction of the image forming apparatus.

FIG. 1 is a schematic diagram showing the construction of the image forming apparatus representing a digital copying machine.

In FIG. 1, the image forming apparatus is provided with automatic document feeding device A (commonly called ADF), document image reading section B which reads an image of a document being fed by the automatic document feeding device A, image processing section C which performs data processing by coding an image of a document read, image carrier 10 representing a photoreceptor drum, charging device 14 which charges potential onto the surface of the image carrier 10, writing section D which exposes the image carrier 10 by emitting laser light based on image data from the image processing section C, image forming section E which forms an electrostatic latent image on the image carrier 10 by the exposure from laser light source 40 constituting the writing section D, developing device 16 which develops the electrostatic latent image on the image carrier 10 into a toner image, transfer device 20 which transfers the toner image on the image carrier 10 onto a transfer sheet P, fixing section H which fixes the toner image on the transfer sheet P by heat of an unillustrated heat source, sheet feeding plates 22 and 24 which contain the transfer sheet P for an image formation, under-mentioned reversing path 19 which reverses a front side and a back side of the transfer sheet P, and under-mentioned registration roller R10. On the sheet feeding plates 22 and 24, there is provided transfer sheet sensor 23 which detects a size of the contained transfer sheet P.

The automatic document feeding device A has document platen 26 and document feed-processing section 28 which includes rollers group including roller R1 and a switching means (having no reference symbol) for switching moving paths of a document appropriately.

The document image reading section B is a reading exposure device which is located under document platen glass G, and can reciprocate while keeping a length of an optical path, and it is composed of two mirror units 30 and 31, fixed image forming lens 32 and image sensor 33, and performs photoelectric conversion for an image of document which is fed by the automatic document feeding device A, to send it as an image signal to the image processing section C.

Firstly, the process for forming an image on the transfer sheet is explained as follows.

When the automatic document feeding device A is used, reading of the document is performed as follows. An unillustrated document feed-driving motor is energized by an electric signal from a control section of an image forming apparatus main body representing an unillustrated control means, then one sheet of the document (unillustrated) on the document platen 26 is fed to the inside of the document feed-processing section 28, passes under the roller Ri, and the reflected light from the document is focused on the image sensor 33, through the mirror units 30 and 31 and lens 32 which are located in the fixed position, and thus, the document is read. On the other hand, when the automatic document feeding device A is not used, reading of the document is performed as follows. That is, an unillustrated mirror unit driving motor is energized by an electric signal from the control section, so that the mirror units 30 and 31 scan the document surface on the document platen glass G, and the reflected light from the document is formed on the image sensor 33 through the lens 32, and thus the document is read.

The image read from the document is stored in an unillustrated memory as image data in the image processing section C.

Next, based on the image data which are read from the memory, laser light source 40 of writing section D is energized. The writing section D is mainly composed of the laser light source 40 and polygon mirror 42. Laser light of the laser light source 40 scans by the rotation of the polygon mirror 42, and exposes the image carrier 10 having been charged, to form the electrostatic latent image.

The surface of the image carrier 10 is cleaned by cleaning device 21 before charging, and is optically neutralized by a neutralizing device (having no reference symbol) having a light source. In other words, the neutralized image carrier 10 is given a charging potential by the application of a grid voltage of charging device 14 by the corona discharging function, and has the.electrostatic latent image based on the image data by the exposure of the laser light.

A developing sleeve (having no reference symbol) of developing device 16 forms a magnetic brush by holding a developer with magnetic force. After that, the developing sleeve on which developing bias has been applied supplies the magnetic brush, which is controlled to be of the prescribed height by the rotation, to the image carrier 10. By the applied developing bias, toner in the developer in the developing sleeve adheres to the image carrier 10 in accordance with the potential of the electrostatic latent image, and a first toner image of the duplex copying is visualized.

On the other hand, reference symbol S is a movable plate, and its free end is always urged upward by an urging means representing an unillustrated coil spring located in the sheet feeding plates 22 and 24, thus, the uppermost sheet P is brought into contact with feed-out roller 60.

The transfer sheet P which is touching the feed-out roller 60 is fed out of the sheet feeding plates 22 and 24 to paired press-contacted rotatable rollers composed of drive roller 61 and driven roller 62. The drive roller 61 rotates to separate the transfer sheets P one by one to convey to registration roller R10. The transfer sheet P, whose leading edge touches the registration roller R10 before the start of the rotation, forms a buckle, and skewing generated during conveyance is corrected. After that, the registration roller R10 starts rotating, synchronizing with timing so that the transfer sheet P may be superposed accurately on the toner image formed on the image carrier 10 at the transfer area, and conveys the transfer sheet P to the transfer area. The transfer sheet P is superposed on the toner image on the image carrier 10 at the transfer area, and the toner image is transferred on the transfer sheet P by the activation of transfer device 20.

After the.transfer sheet P is separated from the image carrier 10 by the activation of separation electrode 18, the toner image on the transfer sheet P is fused and fixed by the heating and pressing function of paired fixing rollers 36 constituting fixing section H, and the transfer sheet P is ejected onto sheet ejection tray T via sheet ejecting roller 39.

When the image formation is performed on the reverse side of the transfer sheet P, on the front side of which the toner image has been transferred, diverting guide 25 is set at the position shown by the broken line in FIG. 1, in order to convey the transfer sheet P to conveyance path 37, and is activated by an unillustrated cam mechanism energized by on-off operation of an unillustrated solenoid so that the diverting guide 25*b* is set at the position shown by the solid line in FIG. 1 after transfer sheet P is conveyed to the conveyance path 37. The conveyance path 37 is formed to have a gentle circled arc to guarantee the smooth movement of the transfer sheet P. The transfer sheet P having descended through the conveyance path 37 crosses the conveyance path (having no reference symbol) for the transfer sheet P coming from manual sheet feeding tray 27, and reaches sheet switch-back roller R20. The sheet switch-back roller R20 consists of paired rollers which can rotate reversely, and conveys the transfer sheet P from a curved guide section (having no ha reference symbol) located at the lower side of the sheet switch-back roller 20 to reversal path 19 having the prescribed space between a bottom section of the sheet feeding tray 24 and a bottom plate of the image forming apparatus main body. A leading edge of the transfer sheet P which reached the sheet switch-back roller R20 is led to the reversal path 19 by the nipping and rotation of the roller R20. In this case, the transfer image surface on the transfer sheet P is facing downward. Then, under the condition that the sheet switch-back roller R20 is nipping the trailing edge of the transfer sheet P, a drive motor (not illustrated) is stopped rotating by a signal coming from an unillustrated trailing edge detection sensor via the control section. After that, when the roller R20 is rotated in reverse direction by a signal from the control section, and the transfer sheet P is fed to reversal feeding path 29 via an unillustrated switch-over guide, under the condition of reversing its front side and reverse side, that is, under the condition that the reverse side of the transfer sheet P on which the image is not transferred is facing the image carrier 10 side. Next, the transfer sheet P is conveyed to feeding roller R25 which is provided to correspond to sheet feeding tray 24 closest to the reversal path 19. Feeding roller R25 conveys the transfer sheet P and makes the leading edge of the transfer sheet P to touch registration roller R10 which is in a stand-by condition for the start of rotation, to form a buckle, and corrects the skewing of the transfer sheet P.

On the other hand, in the case of duplex copying, a second toner image is formed on the image carrier 10, via the process which is the same as the process of a first toner image, the registration roller R10 starts rotating with the timing that is synchronized with the second toner image formed on the image carrier 10, and conveys the transfer sheet P to the transfer area. The second toner image on the image carrier 10 is superposed on the reverse side of the transfer sheet P at the transfer area, and the toner image is transferred onto the transfer sheet P by the activation of transfer device 20. After that, the transfer sheet P is fixed via fixing section H, and is ejected on sheet ejection tray T by sheet ejecting roller 39.

Figure 2:
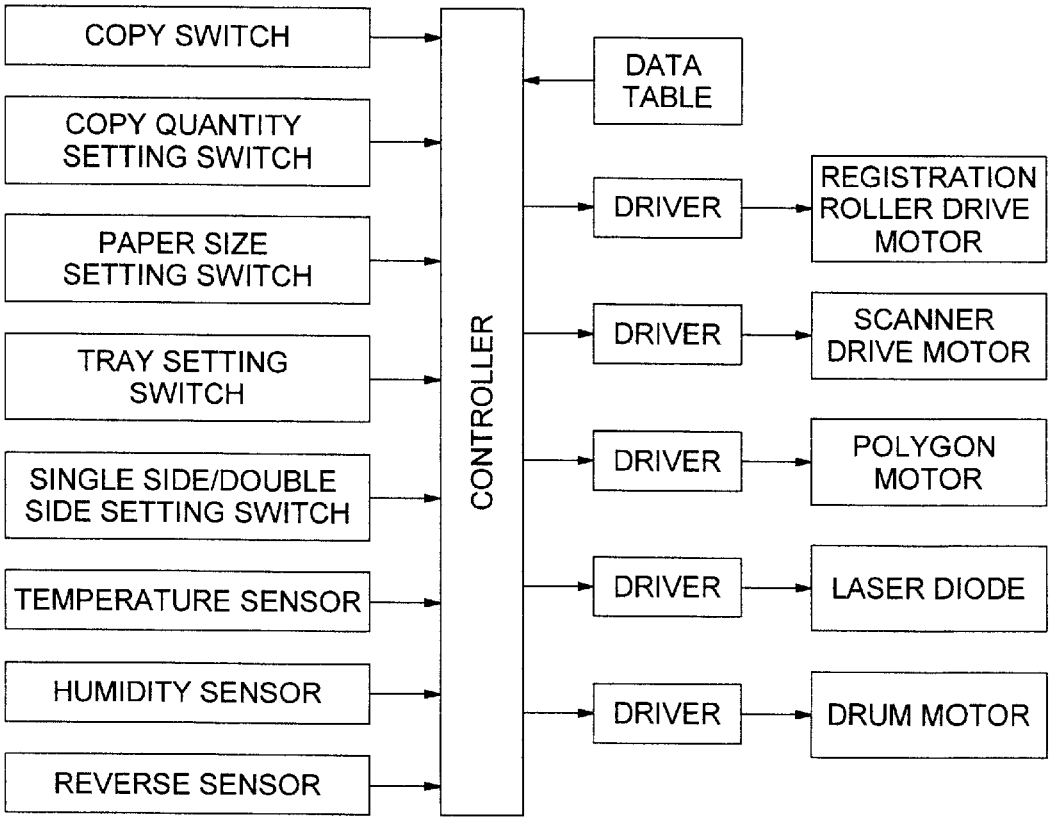
FIG. 2 is a block diagram of the control section of the image forming apparatus.

FIG. 2 is a block diagram of the control section of the image forming apparatus.

The control section controls each section of.the image forming apparatus, and based on an input image received via I/F section (not illustrated) from the image reading section B, controls the image processing section C, image writing section D and image forming section E, and forms an image on the transfer sheet P by the processes of charging, exposure, development, transfer and fixing.

A memory section of the control section has data tables (refer to under-mentioned Table 1, Table 2 and Table 3) containing correction value of the rotating speed of the registration roller, correction value of the rotating speed of the image carrier 10 and the rotating heat body (fixing roller) 36, correction value of the scanning speed of the reading device B, and correction value of the latent image writing speed to the image carrier 10, all for preventing occurrence of transfer jitter of the trailing edge, corresponding to an amount of a buckle of the transfer sheet P, under the change of size conditions for the transfer sheets.

As the input signals for conforming the present condition, the control section receives the electric signal about the sizes of the transfer sheet P stacked on the sheet feeding trays 22 and 24, from transfer sheet sensor 23, and receives the electric signals about temperature and humidity, from unillustrated temperature sensor and humidity sensor, and stores them in a memory section. Further, the electric signals of the coping conditions, representing the designation of the transfer sheet size by a sheet size setting switch (not illustrated), the establishment of the copy quantity by a copy quantity setting switch (not illustrated), the designation of the sheet feeding tray to be used by a tray setting switch (not illustrated), the selection of single side copy or duplex copy for the document by a single side/double side setting switch (not illustrated), and the instruction of starting of copy by a copy switch (not illustrated) are inputted to the control section. When the duplex copy is selected through the single side/double side setting switch, the transfer sheet P is fed out of the sheet feeding tray 22 or 24 by ON operation of the copy switch, and the toner image is transferred on one side of the transfer sheet P, then, after the transfer sheet P is fixed in the fixing device H, it passes through conveyance path 37 in a form of a gentle circled arc, and it is downward conveyed to the roller R20 for switching-back. Reversing sensor 38, located between the conveyance path 37 and the roller R20 for switching-back, transmits the electric signal representing the detection of passage of the transfer sheet P to the control section.

The control section, which has received the input signal from the copy switch, generates an output signal representing an electric signal which starts an unillustrated driver (power supply) of the mirror unit driving motor relating to the reading exposure device B. In the same way, the control section generates an electric signal which drives a driver for an unillustrated drum motor to rotate the image carrier 10, a driver for an unillustrated registration roller driving motor to rotate the registration roller R10, a driver for an unillustrated polygon motor to rotate the polygon mirror 42, and a driver for an unillustrated laser diode to rotate the laser light source 40.

The preferred embodiments of the invention will be explained as follows, referring to Tables 1 to 3.

TABLE 1

| Sheet sizes | Correction values for rotating speed of registration roller (to standard speed) | Correction values for reading and scanning speed (to standard speed) |
|---|---|---|
| A3 | 0.0% | 0.0% |
| B4 | −0.1% | −0.1% |
| A4R | −0.2% | −0.2% |
| B5R | −0.3% | −0.3% |

Table 1 shows a data table for the correction of the rotating speed of the registration roller R10 and the correction of the scanning speed of the reading exposure device B, in the first embodiment of the invention.

In this case, the image forming apparatus is constructed in such a manner that when a scanning speed of the reading exposure device is corrected, a scanning speed of the writing unit is automatically corrected by the same value.

This data table is stored in the storing section of the control section.

It is possible to prevent the transfer jitter of the trailing edge to the utmost, by adjusting a buckle amount of the transfer sheet P to the prescribed amount by changing and controlling the rotating speed of the registration roller R10 in accordance with the size of the transfer sheet P, and further, it is possible to obtain an image having less errors to a correct lengthwise magnification of an image, by controlling the document reading and scanning speed.

That is, by the calculation based on the experimental data of the each size of the transfer sheets, Table 1 shows the correction value to the standard value of the rotating speed of the registration roller driving motor, and the correction value of the scanning speed of the reading exposure device B to the standard value, in order to make the image to be close to the correct lengthwise magnification of an image. Both of the values are smaller than or equal to the standard values to be in a range from 0 to −0.3%, and are equivalent to the values which delay the rotating speed of the registration roller driving motor to the standard value (or design value). Further, by making the correction value of the scanning speed of the reading exposure device B to be equal to the correction value (ratio to the standard value) of the rotating speed of the registration roller driving motor, it is possible to obtain an image having less errors comparing to the correct lengthwise magnification of an image.

For example, when a B5R (symbol R means the sheet feeding direction is longitudinal) transfer sheet is used, the rotating speed of the registration roller R10 is established to be 0.3% slower than the standard value, and a program for the control section is structured.so that the document reading scanning speed and writing scanning speed automatically become 0.3% slower. That is, when the linear speed on an outer periphery of the registration roller R10 is in a range from 50 to 500 mm/sec., the correction value is in the range from −0.15 to −1.5 mm/sec.

In this case, the document reading scanning speed means the rotating speed of the roller R1 conveying the document, when the automatic document feeding device A is used, while, it means the scanning speed of the,mirror unit 30, when the automatic document feeding device A is not used.

TABLE 2

| Sheet sizes | Correction values of rotating speed of registration roller (to standard speed) | Correction values of writing speed (to standard speed) |
|---|---|---|
| A3 | 0.0% | 0.0% |
| B4 | −0.1% | −0.1% |
| A4R | −0.2% | −0.2% |
| B5R | −0.3% | −0.3% |

Table 2 shows a data table for the correction of the rotating speed of the registration roller R10, and the correction of the speed of writing a latent image on the image carrier 10, in the second embodiment of the invention.

This data table is stored in the storing section of the control section. It is possible to prevent the transfer jitter of the trailing edge to the utmost, by adjusting a buckle amount of the transfer sheet P to the prescribed amount by changing and controlling the rotating speed of the registration roller R10 in accordance with the size of the transfer sheet P, as well as it is possible to obtain an image having less errors to a correct lengthwise magnification of an image by controlling the document writing speed of the writing section D.

That is, by the calculation based on the experimental data of the each size of the transfer sheets, Table 2 shows the correction value to the standard value of the rotating speed of the registration roller driving motor, and the correction value to the standard value of the writing speed of the writing section D, in order to make the image to be close to the correct lengthwise magnification of an image. Both of the values are smaller than or equal to the standard values to be in a range from 0 to −0.3%, and are equivalent to the values which delay the rotating speed of the registration roller driving motor to the standard value (or design value). Further, by making the correction value of the writing speed of the writing section D to be equal to the correction value (ratio to the standard value) of the rotating speed of the registration roller driving motor, it is possible to obtain an image having less errors comparing to the correct lengthwise magnification of an image.

For example, the program of the control section is structured so that, when the rotating speed of the registration roller R10 is set to be 0.3% slower, the writing speed of the writing section D automatically becomes 0.3% slower. That is, when the linear speed on an outer periphery of the registration roller R10 is in the range from 50 to 500 mm/sec., the correction value is in the range from −0.15 to −1.5 mm/sec.

TABLE 3

| Sheet sizes | Correction values of rotating speed of registration roller (to standard speed) | Correction values of rotating speed of image carrier (to standard speed) | Correction values of rotating speed of fixing roller (to standard speed) |
|---|---|---|---|
| A3 | 0.0% | 0.0% | 0.0% |
| B4 | 0.0% | 0.1% | 0.1% |
| A4R | 0.0% | 0.2% | 0.2% |
| B5R | 0.0% | 0.3% | 0.3% |

Table 3 shows a data table for the correction of the rotating speed of the registration roller R10, and the correction of the rotating speed of the image carrier 10 and the fixing roller 36, in the third embodiment of the invention.

This data table is stored in the storing section of the control section. It is possible to prevent the transfer jitter of the trailing edge to the utmost, by adjusting a buckle amount of the transfer sheet P to the prescribed amount by changing and controlling the relative rotating speed of the registration roller R10 and the image carrier 10 in accordance with the size of the transfer sheet P, as well as it is possible to obtain an image having less errors to a correct lengthwise by changing and controlling the rotating speed of the image carrier 10 and the fixing roller 36.

That is, by the calculation based on experimental data of the each size of the transfer sheets, Table 3 shows the correction value to the standard value of the rotating speed of the registration roller driving motor, and the correction value to the standard value of the rotating speed of the image carrier 10 and the fixing roller 36, in order to make the image to be close to the correct lengthwise magnification of an image. In this example, the correction value for the rotating speed of the registration roller driving motor to the standard value (design value) is zero. Further, by making the correction value of the rotating speed of the image carrier 10 and the fixing roller 36 to be in a range from 0 to +0.3%, it is possible to obtain an image having less errors comparing to the correct lengthwise magnification of an image.

One example of the relationship of the rotating speed among the registration roller R10, the image carrier 10 and the fixing roller 36 is explained by the following conditions (1) to (5). Here, a rotating speed of a roller or an image carrier means a circumferential line speed of the drum or the image carrier.

Condition (1) The image carrier 10 and the fixing roller 36 have the same driving source.

Condition (2) The rotating speed of the image carrier is not equal to that of the fixing roller 36.

Condition (3) For example, when the rotating speed of the image carrier is 1, and the rotating speed of the fixing roller 36 is X (X<1), if the rotating speed of the registration roller R10 is 1, the lengthwise magnification of an image is 1/1 and no problem, while the amount of the buckle of the transfer sheet which causes the transfer jitter of the trailing edge is not corrected. Accordingly, to make the amount of the buckle to be the prescribed amount, the rotating speed of the registration roller R10 is corrected to be X so as to be the same as the rotating speed of the fixing roller 36.

Condition (4) Since the lengthwise magnification of an image is determined by the rotating speed of the registration roller R10, the magnification becomes X times on the transfer sheet under the Condition (3), and the correct lengthwise magnification of an image cannot be obtained. Therefore, the each rotating speed for the image carrier 10, the fixing roller 36 and the registration roller R10 is increased by Y (Y=1/X) times, and the rotating speed of the registration roller R10 is increased to be 1 (XY=1). As a result, the rotating speed of the image carrier 10 becomes Y, and that of the registration roller R10 becomes 1, and a ratio of the rotating speed of the registration roller R10 to that of the image carrier 10 becomes 1/Y. Since the writing speed onto the image carrier 10 is not changed, the lengthwise magnification of an image on the image carrier 10 becomes Y/1. Accordingly, the lengthwise magnification of an image on the transfer sheet is (1/Y)×(Y/1)=1, and it is expected to be the correct magnification.

Condition (5) The transfer jitter of the trailing edge hardly occurs and the error of the lengthwise magnification of an image becomes smaller, because the program for the control section has been structured as mentioned in the Conditions (3) and (4).

Figure 3:
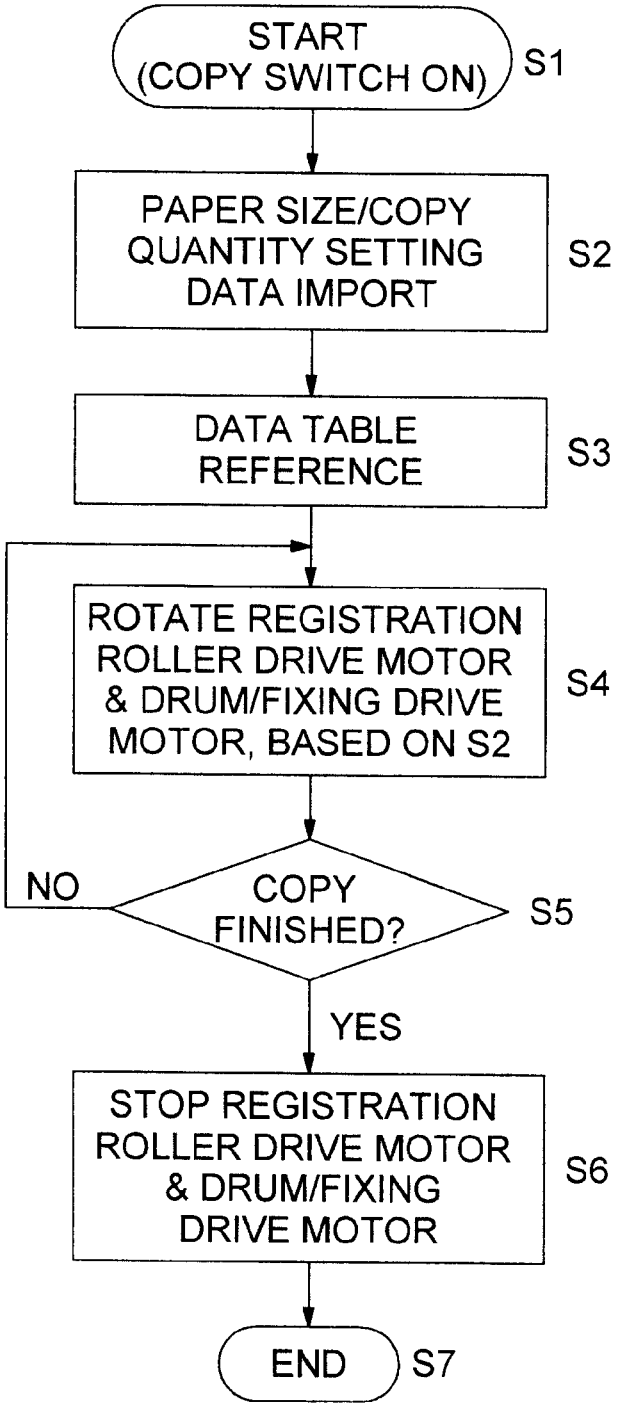
FIG. 3 is a flow chart showing a third embodiment.

FIG. 3 shows a flow chart of the third embodiment. Each step is explained as follows.

(S1) The copy switch is turned ON.

(S2) The signals for sheet size selection and the copy quantity setting are taken in from the sheet size setting switch and the copy quantity setting switch.

(S3) The control section takes in the sheet size data, and refers to the data table.

(S4) The rotating speeds of the registration roller driving motor and the drum and fixing driving motor are taken out of the data table, and these two motors are started by the obtained rotating speeds respectively.

(S5) It is judged whether the copying for the quantity that is set by the copy quantity setting switch is completed or not. If it is not completed, the flow goes back to (S4).

(S6) The registration roller driving motor and the drum and fixing driving motor are stopped.

(S7) The flow ends.

Three embodiments have been explained as stated above, and as another embodiment other than the foregoing, if the buckle amount of the transfer sheet is adjusted by the change of the rotating speed of the registration roller depending on the transfer sheet sizes, and if the reading speed, writing speed and the rotating speed of the image carrier are adjusted, in order to adjust the lengthwise magnification of an image, it is possible to obtain an image having no transfer jitter and an appropriate lengthwise magnification.

Incidentally, only the transfer sheet size has been picked up as a main factor that causes the buckle of the transfer sheet relating to the transfer jitter of the trailing edge, however, there are other causes such as temperature, humidity, the front and the back of the transfer sheet, and the position of the sheet feeding tray. Even these cases, the buckle of the transfer sheet is reduced and the transfer jitter of the trailing edge can be reduced, by preparing the data table mentioned in the present invention, and by applying the control of the registration roller.

Though the fixing roller has been mentioned as the heating and rotating body in the above description, however, the invention may also be applied to an endless fixing belt composed of a silicon rubber which is trained rotatably about a plurality of holding rollers.

The invention males it possible to provide an image forming apparatus wherein occurrence of the transfer jitter of the trailing edge of the image can be prevented to the utmost, and an error of the lengthwise magnification of an image is less.

What is claimed is:

1. An image forming apparatus comprising:

a rotatable-image carrier;

a writing exposure device to write the image and form a latent image in the rotatable image carrier;

a developing device to form a toner image by developing the latent image;

a registration roller to convey a transfer sheet to an image transfer area where the toner image is transferred from the image carrier onto the transfer sheet;

a fixing roller to heat and fix the toner image on the transfer sheet, and a controller to control the image forming apparatus, wherein in cases where a length of the transfer sheet is longer than a length of a transfer sheet path between a nip position of the registration roller and a nip position of the fixing roller, according to a size of the transfer sheet, the controller changes and controls a relative rotating speed of the registration roller to a rotating speed of the fixing roller, and one of a rotating speed of the rotatable image carrier and a writing speed of the image onto the rotatable image carrier.

2. The image forming apparatus of claim 1, wherein according to the size of the transfer sheet, the controller changes and controls the rotating speed of the registration roller, and the writing speed of the image onto the rotatable image carrier.

3. The image forming apparatus of claim 1, wherein according to the size of the transfer sheet, the controller changes and controls the rotating speed of the registration roller, the rotating speed of the rotatable image carrier, and the rotating speed of the fixing roller.

4. The image forming apparatus of claim 1, wherein a diameter of the central section of the fixing roller is smaller than a diameter of the each end section of the fixing roller.

5. The image forming apparatus of claim 4, wherein when the transfer sheet of the shorter feeding edge is used, the slower the controller controls the rotating speed of the registration roller and the rotatable image carrier.

* * * * *